United States Patent [19]

Ludwig et al.

[11] 4,313,274

[45] Feb. 2, 1982

[54] FIRING PIN SAFETY DEVICE FOR HAND FIREARMS

[75] Inventors: Walter Ludwig, Ulm, Fed. Rep. of Germany; Franziska Schmid, deceased, late of Langenau, Fed. Rep. of Germany, by Hans Schmid, executor

[73] Assignee: Carl Walther GmbH, Ulm, Fed. Rep. of Germany

[21] Appl. No.: 102,527

[22] Filed: Dec. 11, 1979

[30] Foreign Application Priority Data

Dec. 21, 1978 [DE] Fed. Rep. of Germany ..... 2855224

[51] Int. Cl.[3] ..... F41C 17/04

[52] U.S. Cl. ..... 42/70 F

[58] Field of Search ..... 42/70 F

[56] References Cited

U.S. PATENT DOCUMENTS

| | | | |
|---|---|---|---|
| 3,724,113 | 4/1973 | Ludwig | 42/70 F |
| 4,011,678 | 3/1977 | Brodbeek et al. | 42/70 F |
| 4,090,316 | 5/1978 | Volkmar | 42/70 F |

*Primary Examiner*—Charles T. Jordan

*Attorney, Agent, or Firm*—Edmund M. Jaskiewicz

[57] ABSTRACT

A hand firearm has an axially movable firing pin which can be secured against axial displacement and a pivotable hammer which is retained in its cocked position by a safety lever. Upon actuation of the trigger a trigger arm first engages a release lever to disengage the firing pin from axial securement and subsequently engages the safety lever to release the safety lever from the hammer so that the hammer under the action of a spring moves from its cocked position to the firing position. The free end of the trigger arm is provided with longitudinally and laterally mutually offset abutments which sequentially engage the release lever and then the safety lever.

5 Claims, 6 Drawing Figures

FIRING PIN SAFETY DEVICE FOR HAND FIREARMS

The present invention relates to a firing pin safety device for hand firearms such as automatic pistols, more particularly, to structure for sequentially releasing the firing pin from an axially secured position and for disengaging the safety lever from the cocked hammer.

Hand firearms and particularly automatic pistols have been provided with a firing pin safety device in which actuation of the trigger will move a trigger arm which in turn engages a release lever to disengage the firing pin from being axially secured so that the firing pin is in a position to be engaged by the hammer which has been held in the cocked position by a safety catch. The purpose of such safety devices has been to retain the firing pin in the axially secured position until such a time as the trigger is actuated. In its secured position, the firing pin is locked against any axial movement so that in the event of an unintentional or inadvertent striking of the hammer on the firing pin the firing pin is incapable of movement to reach the primer cap on the cartridge and the firing of a shot is impossible.

One particular form of such a firing pin safety device has been proposed in which the firing pin is released for axial movement or for firing a shot by the pivoting of a release lever. For this purpose, the trigger arm which is actuated by the trigger is engageable with the release lever. The release lever is pivoted by actuation of the trigger so as to bring the firing pin into the firing position. As the release lever pivots, a lug of the release lever engages or strikes a safety catch which is holding the hammer in the cocked position. This releases the safety catch so that the hammer is able to pivot forwardly into its firing position under the action of its striking spring. When the hammer has reached its end or firing position, the firing pin has already been positioned in an axially unsecured position so that the firing pin is driven forwardly by the hammer to bring about a discharge of the cartridge.

This described firing pin safety device has the disadvantage that the movement of the trigger arm is transmitted through the intermediary of the release lever to the safety catch. As a result of the structure it is possible that the manufacturing tolerances of the trigger arm, release lever and safety catch are added to accumulate in the unfavorable direction. As a result, the reliability and functioning of the safety device may be impaired. Avoiding of this adding of tolerances can only be prevented by following very fine tolerances during the manufacturing operations. Such manufacturing operations, however, result in a significant and considerable increase in the manufacturing cost of the firearm.

Even apart from the expense of the firearm, the safety of the firearm can be greatly impaired by this structure. For example, if the release lever is in the "safety off" position, the safety catch is simultaneously disengaged from the hammer. If, for any reason, the safety lever jams in the "safety off" position and can no longer be returned to the secured position, the safety catch will also remain in its disengaged position. Under these circumstances it is possible for an inadvertent actuation of the hammer to cause the hammer to strike against the unsecured firing pin and the result is the firing of an unintentional shot.

It is therefore the principal object of the present invention to provide a novel and improved firing pin safety device for hand firearms.

It is another object of the present invention to provide a firing pin safety device of the type described above wherein the reliability and security of the safety structure is significantly improved while maintaining manufacturing tolerances at reasonable limits.

In order to achieve these objects, the present invention essentially provides that the trigger arm has in its longitudinal direction two abutment surfaces arranged one behind the other. The first abutment non-positively connects directly to a projection on the release lever upon actuation of the trigger after first passing through a suitable safety distance or play. The second abutment is non-positively connected directly to a safety catch after passing through a further safety distance.

According to one aspect of the present invention a firing pin safety device for hand firearms, such as automatic pistols, and the like may comprise an axially displaceable firing pin which can be secured against axial displacement. Means including a release lever are provided for releasing the firing pin from its secured position to enable the firing pin to be displaced axially. A safety lever is engageable with a pivotally mounted hammer to retain the hammer in a cocked position. A trigger arm which is actuated by a trigger has a first means thereon for actuating the release means to disengage the means securing the firing pin against axial displacement and second means for disengaging the safety lever from the cocked hammer when the trigger arm is actuated by the trigger.

Other objects and advantages of the present invention will be apparent upon reference to the accompanying description when taken in conjunction with the following drawings, which are exemplary, wherein.

Proceeding next to the drawings wherein like reference symbols indicate the same parts throughout the various views a specific embodiment and modifications of the present invention will be described in detail.

Figure 1:
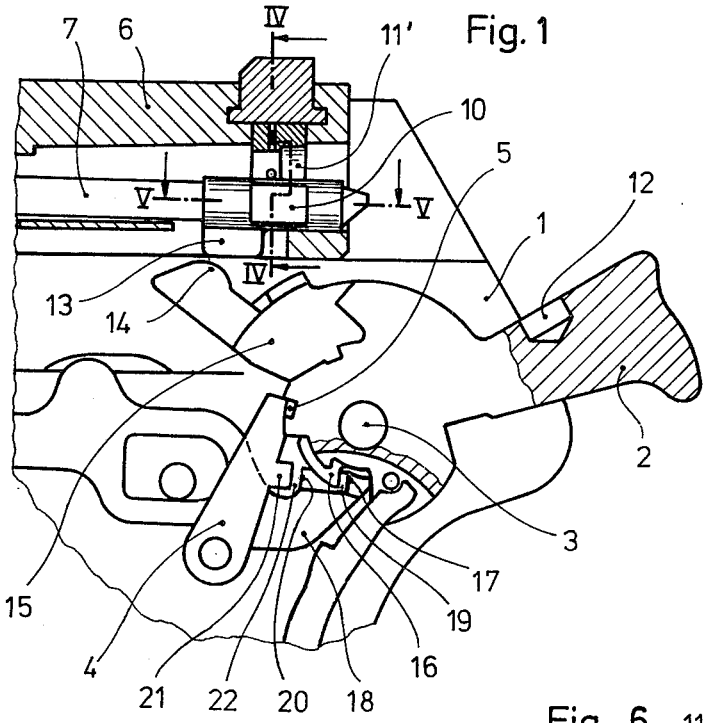
FIG. 1 is a longitudinal sectional view through a portion of a firearm incorporating the present invention showing the firing pin in its axially secured position and the hammer in the cocked position.

In FIG. 1 there is illustrated a portion of a hand firearm which may be an automatic pistol having a handle 1 in which a hammer 2 is mounted to pivot about a horizontal axis 3 positioned transversely with respect to the direction of fire of the firearm. The hammer 2 is retained in its cocked position by a pivotally mounted safety catch or lever 4 the free end of which is engaged in a notch 5 in the hammer 2. The hammer is urged in a counterclockwise direction from its cocked position by a striking spring which is not shown but is known in the art and may comprise a compressed spring acting upon a biasing rod which is engageable with a portion of the hammer to cause the hammer to move from its cocked position.

Figure 4:
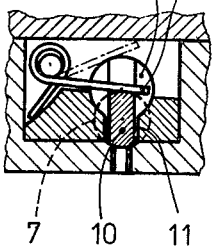
FIG. 4 is a sectional view taken along the line IV—IV of FIG. 1.
Figure 5:
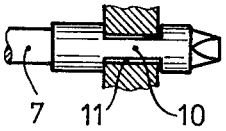
FIG. 5 is a sectional view taken along the line V—V of FIG. 1 and showing the firing pin in its axially secured position.
Figure 6:
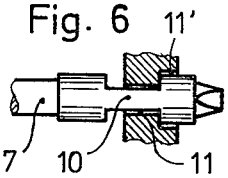
FIG. 6 is a sectional view taken along the line VI—VI of FIG. 2 showing the firing pin in its axially released position.

A firing pin 7 is mounted in a breech housing 6 so as to be axially displaceable therein and is also pivotable about its front or firing end. The firing pin is urged into its rearward position away from a cartridge in the chamber by means of a spring 8. A second spring 9 acts upon the firing pin 7 in the vertical direction so as to pivot the firing pin downwardly about its firing end into an axially secured position as shown in FIGS. 1, 4 and 5. In this axially secured position, the firing pin has a flattened central portion 10 which is positioned in a vertical groove 11 formed in the breech housing 6 and the firing pin is thus locked against movement in the axial direction. The upper portion of groove 11 is provided with a recess 11' having a diameter somewhat greater than the diameter of the firing pin so as to be able to receive a portion of the firing pin during the firing operation as shown in FIG. 6.

Further protection against inadvertent firing of a shot is provided by a recess 12 in the hammer 2 which is positioned opposite the rearward downwardly pivoted end of the firing pin so as to receive this end of the firing pin should the hammer 2 be inadvertently released. Receiving of the end of the firing pin in the recess 12 will thus prevent striking of the firing pin with the hammer.

On the underside of the rearward end of the firing pin 7 there is formed a downwardly depending shoulder 13 which is engageable by a lug 14 on a release lever 15 which is pivotally mounted on the shaft 3 coaxially with the hammer 2. The lug 14 on the release lever 15 is positioned directly below the shoulder 13 of the firing pin 7 so that pivoting of the release lever 15 in the clockwise direction will cause the lug 14 to engage the shoulder 13 in the manner shown in FIG. 2.

The release lever 15 is also provided with a projection 16 which is engageable by a stop or abutment surface 17 on the end portion of a trigger arm 18. The trigger arm 18 is operatively connected to the trigger of the firearm, not shown, so that as the trigger is pulled to actuate the firearm the trigger arm 18 moves toward the left as viewed in the drawings.

The trigger arm 18 has a second abutment or stop surface 20 which is engageable with a stop 21 on the safety lever 4.

A safety distance or clearance 19 is provided between the abutment surface 17 and the projection 16 and a similar safety distance or clearance 22 is provided between the abutment surface 20 and the stop 21.

Figure 3:
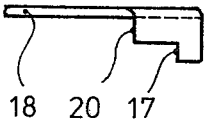
FIG. 3 is a top plan view of the rearward end of the trigger arm.

The abutment surfaces 17 and 20 are formed on a lateral portion on the free upwardly directed end of the trigger arm. The stop surfaces 17 and 20 are formed so that these stop surfaces are mutually offset longitudinally and laterally as may be seen in FIG. 3. The lateral offsetting of the stop surfaces 17 and 20 corresponds with the lateral offsetting of the projection 16 on the release lever 15 and the stop 21 on the catch lever 4.

Figure 2:
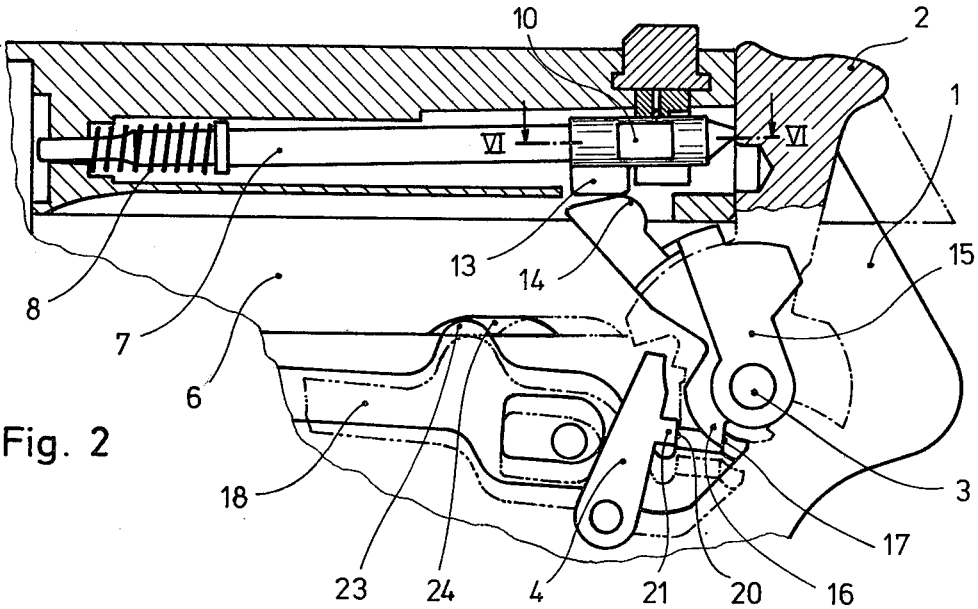
FIG. 2 is a view similar to that of FIG. 1 but showing the firing pin in the firing position and the hammer in the firing position.

When the trigger, which is not shown, is moved in the firing direction, the trigger arm 18 will be actuated to move toward the left so as to bring the abutment surface 17 against the projection 16 after passing through the safety distance 19. Engaging of the projection 16 by the trigger arm abutment 17 causes the release lever 15 to pivot clockwise which in turn causes the lug 14 to pivot into engagement with the shoulder 13 on the firing pin to raise the firing pin 7 within vertical groove 11 against the force of spring 9. Before the firing pin 7 has reached its upward firing position as shown in FIG. 2, the abutment surface 20 on the trigger arm 18, after passing through the safety distance 22 will engage the stop 21 of the safety lever 4. The safety lever 4 will thus be caused to pivot in a counterclockwise direction to disengage its end from the notch 5 of the hammer 2. The hammer 2 will thus be pivoted forwardly in a counterclockwise direction to the firing position under the force of its spring, not shown, so that the hammer impacts against the end of the firing pin as shown in FIG. 2.

Since the firing pin 7 has been lifted into its upper or firing position (FIG. 6) it is no longer restricted against axial movement and under impact of the hammer 2 will move forwardly into the recess 11' in the axial direction and fire the cartridge. The instance of firing is shown in FIG. 2.

The position of the trigger arm 18 shown in dot dashed lines in FIG. 2 illustrates the interrupted position of the trigger device when the breech is open. When the breech is closed, a lug 23 on the upper surface of the trigger arm 18 engages in a recess 24 formed on the underside of the breech housing 6. When the breech housing 6 moves back into the opening position, the lug 23 is pushed out of the recess 24 and the trigger arm 18 moves downwardly. This downward movement of the trigger arm 18 disrupts the driving or operating connection between the trigger arm 18, release lever 15 and safety lever 14 so that the trigger mechanism is not able to operate.

Thus it can be seen that the present invention has provided an improved and effective firing pin safety device which, in sequence, releases the firing pin from being axially secured and then releases the hammer so that the hammer under the force of a spring will strike the firing pin. It is apparent that a particular advantage of the present invention is that operation of the safety lever by any other element other than the trigger arm is completely excluded. The result is a very high degree of security against inadvertent firing of a shot. In addition, the construction of the trigger arm according to the present invention greatly simplifies manufacturing operations since the requirements on manufacturing tolerances are decreased.

It will be understood that this invention is susceptible to modification in order to adapt it to different usages and conditions, and accordingly, it is desired to comprehend such modifications within this invention as may fall within the scope of the appended claims.

We claim:

1. In a firing pin safety device for hand firearms, an axially displaceable firing pin, means for securing said firing pin against axial movement, means including a release lever for releasing said firing pin from said securing means to enable said firing pin to be displaced axially, a hammer pivotable between a cocked position and a firing position, a safety lever engageable with said hammer to retain said hammer in a cocked position, a trigger arm acuated by a trigger, and a first abutment on said trigger arm to engage said release lever to disengage said securing means and a second abutment on said trigger arm to engage said safety lever to disengage said safety lever from said cocked hammer when said trigger arm is actuated by the trigger.

2. In a firing pin safety device for hand firearms as claimed in claim 1 wherein said first and second abutments are positioned such that upon actuation of said trigger arm said firing pin is released for axial movement and subsequently said hammer is released from its cocked position.

3. In a firing pin safety device for hand firearms as claimed in claim 1 wherein said first abutment is directly engageable with a projection of said release lever and said second abutment is directly engageable with a stop on said safety lever.

4. In a firing pin safety device for hand firearms as claimed in claim 3 wherein there is a first safety distance between said first abutment and said projection and a second safety distance between said second abutment and said stop on said safety lever.

5. In a firing pin safety device for hand firearms as claimed in claim 3 wherein said trigger arm has a free upwardly directed end and there is a lateral portion on said end, said first and second abutments being on said lateral portion and being offset mutually longitudinally and laterally.

* * * * *